United States Patent [19]

Teshima et al.

[11] 3,943,813

[45] Mar. 16, 1976

[54] AUTOMATIC MUSIC PLAYING SYSTEM

[75] Inventors: Haruto Teshima, Hirakata; Toshiaki Inui, Nara, both of Japan

[73] Assignee: Matsushita Electric Industrial Company, Ltd., Osaka, Japan

[22] Filed: Oct. 7, 1974

[21] Appl. No.: 512,954

[30] Foreign Application Priority Data

| | | |
|---|---|---|
| Oct. 15, 1973 | Japan | 48-116046 |
| Oct. 18, 1973 | Japan | 48-117593 |
| Oct. 18, 1973 | Japan | 48-117594 |
| Oct. 24, 1973 | Japan | 48-120117 |
| Oct. 24, 1973 | Japan | 48-120118 |
| Oct. 16, 1973 | Japan | 48-120407[U] |

[52] U.S. Cl. ..... 84/1.03; 84/1.13; 84/1.26; 84/DIG. 12

[51] Int. Cl.[2] ..... G10H 1/02; G10H 5/04

[58] Field of Search ..... 84/1.01, 1.03, 1.17, 1.24, 84/DIG. 12, DIG. 22, 1.13, 1.26

[56] References Cited

UNITED STATES PATENTS

| | | | |
|---|---|---|---|
| 3,358,068 | 12/1967 | Campbell, Jr. | 84/1.01 |
| 3,546,355 | 12/1970 | Maynard | 84/1.03 |
| 3,743,757 | 7/1973 | Okamoto | 84/1.03 |
| R26,521 | 2/1969 | Park | 84/1.03 |

OTHER PUBLICATIONS

Donald O. Pederson et al., Introduction to Electronic Systems, Circuits, and Devices, McGraw-Hill Book Company, Copyright 1966, pp. 312–315.

*Primary Examiner*—L. T. Hix
*Assistant Examiner*—Stanley J. Witkowski
*Attorney, Agent, or Firm*—Stevens, Davis, Miller & Mosher

[57] ABSTRACT

An automatic music playing system including a matrix circuit and manual play switches both connected to tone signal generators, each of said manual play switches consisting of a series connection of a resistor and a switch and a capacitor connected between the interconnection of said resistor and switch and the input terminal of a corresponding tone signal generator so that the output signals of said matrix circuit is absorbed in said capacitor when said switch is closed and an on-off switch operation triggers the corresponding tone signal generator, and each of said tone signal generators including two oscillating transistors connected with a feed-back loop and provided with a damping resistor.

5 Claims, 5 Drawing Figures

FIG. 4

Figure 1:
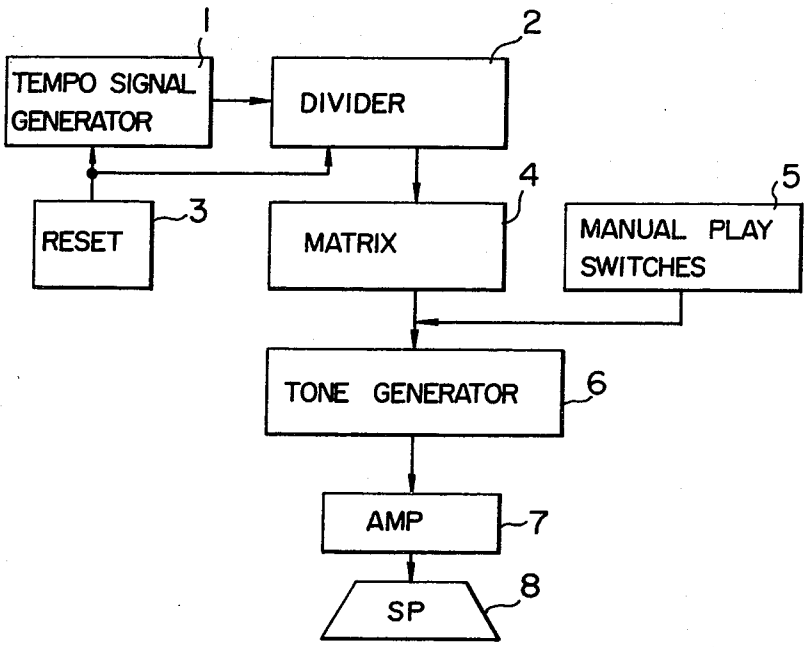

| OUTPUTS OF THE DIVIDER | | | | | | MARCH | | | WALTZ | | | FOX TROT | | | ROCK | | |
|---|---|---|---|---|---|---|---|---|---|---|---|---|---|---|---|---|---|
| | | | | | | $TR_5$ | $TR_6$ | $TR_8$ | $TR_5$ | $TR_6$ | $TR_8$ | $TR_5$ | $TR_6$ | $TR_8$ | $TR_5$ | $TR_6$ | $TR_8$ |
| | a | b | c | d | e | BD | SD | CY | BD | SD | CY | BD | SD | CY | BD | SD | CY |
| 32 | 1 | 1 | 1 | 1 | 1 | 1 | | 1 | 1 | | 1 | 1 | | 1 | 1 | | 1 |
| 1 | 0 | 0 | 0 | 0 | 0 | | | | | | | | | | | | |
| 2 | 1 | 0 | 0 | 0 | 0 | | | | | | | | | | | | |
| 3 | 0 | 1 | 0 | 0 | 0 | | | | | | | | | | | | |
| 4 | 1 | 1 | 0 | 0 | 0 | | | | | | | | | 1 | | | 1 |
| 5 | 0 | 0 | 1 | 0 | 0 | | | | | | | | | | | | |
| 6 | 1 | 0 | 1 | 0 | 0 | | | | | | | | | | | | |
| 7 | 0 | 1 | 1 | 0 | 0 | | | | | | | | | | | | |
| 8 | 1 | 1 | 1 | 0 | 0 | | 1 | | | | | | 1 | 1 | | 1 | 1 |
| 9 | 0 | 0 | 0 | 1 | 0 | | | | | | | | | | | | |
| 10 | 1 | 0 | 0 | 1 | 0 | | | | | | | | | | | | |
| 11 | 0 | 1 | 0 | 1 | 0 | | | | | 1 | | | | | | | |
| 12 | 1 | 1 | 0 | 1 | 0 | | | | | | | | | 1 | 1 | 1 | 1 |
| 13 | 0 | 0 | 1 | 1 | 0 | | | | | | | | | | | | |
| 14 | 1 | 0 | 1 | 1 | 0 | | | | | | | | | | | | |
| 15 | 0 | 1 | 1 | 1 | 0 | | | | | | | | | | | | |
| 16 | 1 | 1 | 1 | 1 | 0 | 1 | | 1 | | | | | 1 | 1 | 1 | | 1 |
| 17 | 0 | 0 | 0 | 0 | 1 | | | | | | | | | | | | |
| 18 | 1 | 0 | 0 | 0 | 1 | | | | | | | | | | | | |
| 19 | 0 | 1 | 0 | 0 | 1 | | | | | | | | | | | | |
| 20 | 1 | 1 | 0 | 0 | 1 | | | | | | | | | 1 | | | 1 |
| 21 | 0 | 0 | 1 | 0 | 1 | | | | | | | | | | | | |
| 22 | 1 | 0 | 1 | 0 | 1 | | | | | 1 | | | | | | | |
| 23 | 0 | 1 | 1 | 0 | 1 | | | | | | | | | | | | |
| 24 | 1 | 1 | 1 | 0 | 1 | | 1 | | | | | | 1 | 1 | | 1 | 1 |
| 25 | 0 | 0 | 0 | 1 | 1 | | | | | | | | | | | | |
| 26 | 1 | 0 | 0 | 1 | 1 | | | | | | | | | | | | |
| 27 | 0 | 1 | 0 | 1 | 1 | | | | | | | | | | | | |
| 28 | 1 | 1 | 0 | 1 | 1 | | | | | | | | | 1 | | | 1 |
| 29 | 0 | 0 | 1 | 1 | 1 | | | | | | | | | | | | |
| 30 | 1 | 0 | 1 | 1 | 1 | | | | | | | | | | | | |
| 31 | 0 | 1 | 1 | 1 | 1 | | | | | | | | | | | | |

AUTOMATIC MUSIC PLAYING SYSTEM

This invention relates to an automatic music playing system which automatically excites a plurality of tone source circuits in a predetermined music pattern and automatically plays a desired rhythm and/or melody.

As is well known, an automatic music playing system consists of a tempo signal generating circuit for determining the tempo of the automatic play, a frequency divider for dividing the frequency of the tempo signal, a matrix circuit for determining the pattern of rhythm or melody to be played automatically in response to the outputs of the frequency divider, a group of tone signal generators triggered by the output of the matrix circuit for electronically generating quasi-sound signals of base-drum, etc., a low frequency amplifier circuit for synthesizing and amplifying the output signals of the respective tone signal generators, and a loudspeaker system driven by this amplifier circuit. Many kinds of automatic rhythm playing systems for use as an accompaniment to an electronic organ are commercially available. These conventional automatic music playing systems, however, are complicated and expensive and further can only play a repetitive performance of a predetermined rhythm.

An object of this invention is to provide an automatic music playing system provided with manual play switches, thereby extending the use of other systems.

Another object of this invention is to provide a simple and low-cost automatic music playing system, thereby bringing the automatic music playing into wide use.

For this purpose, this invention intends to provide a cheap and simple matrix circuit, tone signal generators of low-cost capable of generating excellent tones in a wide temperature range, and a simple reset circuit for resetting a tempo signal generating circuit and a frequency divider so as to begin the automatic musical performance always at the first beat.

According to one aspect of this invention, there is provided an automatic music playing system comprising a tempo signal generating circuit for generating a pulse signal determining the tempo of an automatically played rhythm, a frequency dividing circuit for dividing the frequency of the pulse signal of said tempo signal generating circuit, a matrix circuit for receiving the output signals of said frequency dividing circuit and generating a plurality of driving signals of predetermined patterns, a plurality of manual play switch circuits, a plurality of tone signal generating circuits for generating tone signals for rhythm sounds based on the signals derived from said matrix circuit and said manual play switch circuits, an amplifier for amplifying the output of the tone signal generating circuits, and a loudspeaker system.

According to this invention, there is provided an economical and convenient automatic music playing system capable of playing with an arbitrary rhythm by a manual switch and of offering variation by adding and erasing the sounds of snare drums during the automatic playing of rock etc.

Figure 2:
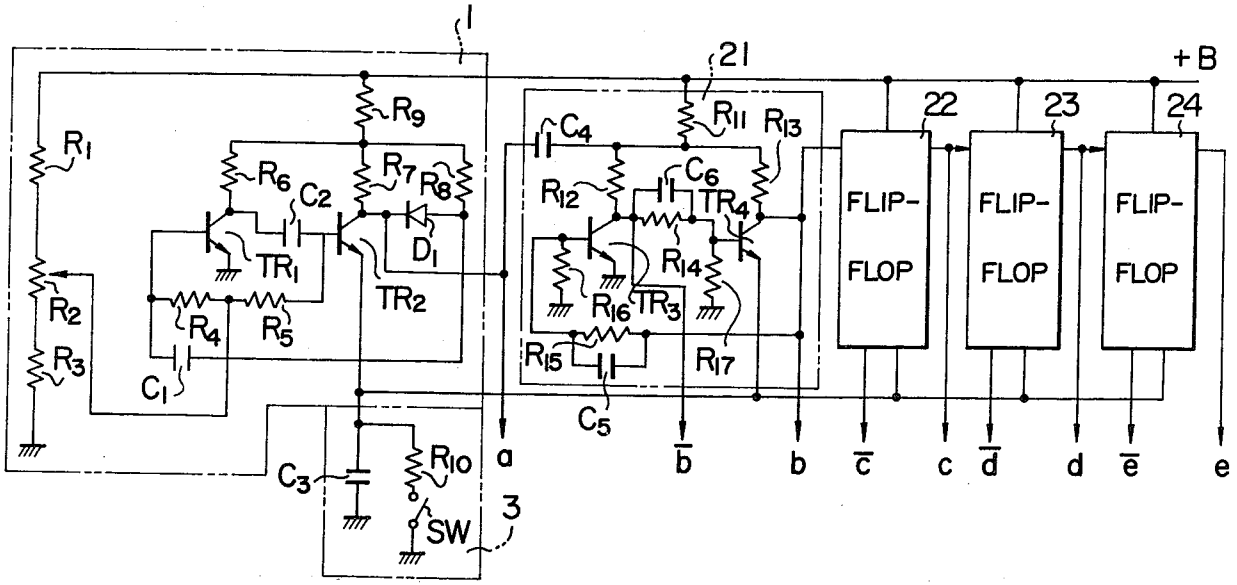
Figure 3:
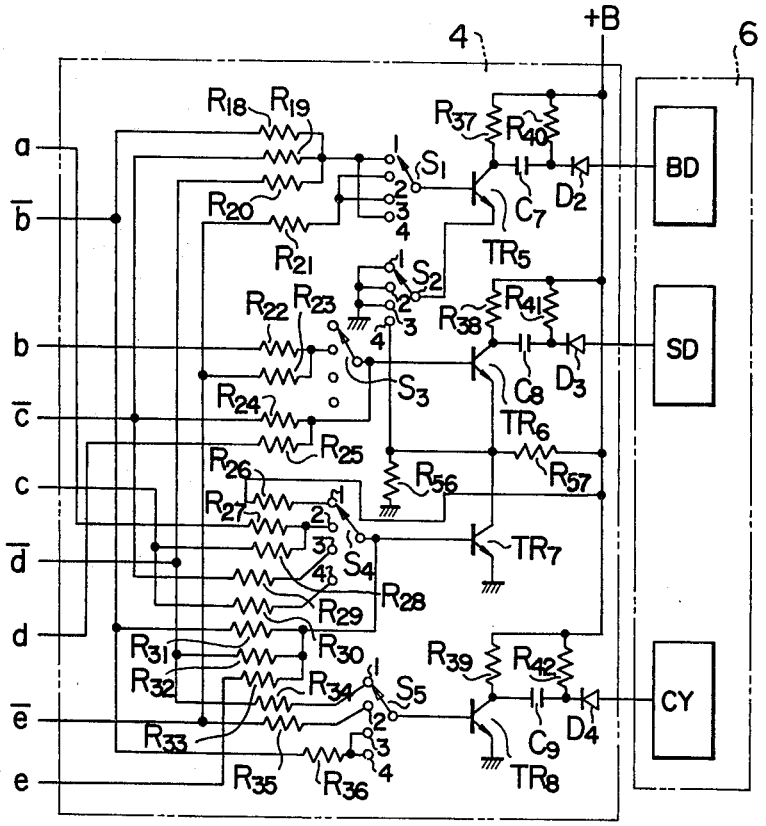
Figure 5:
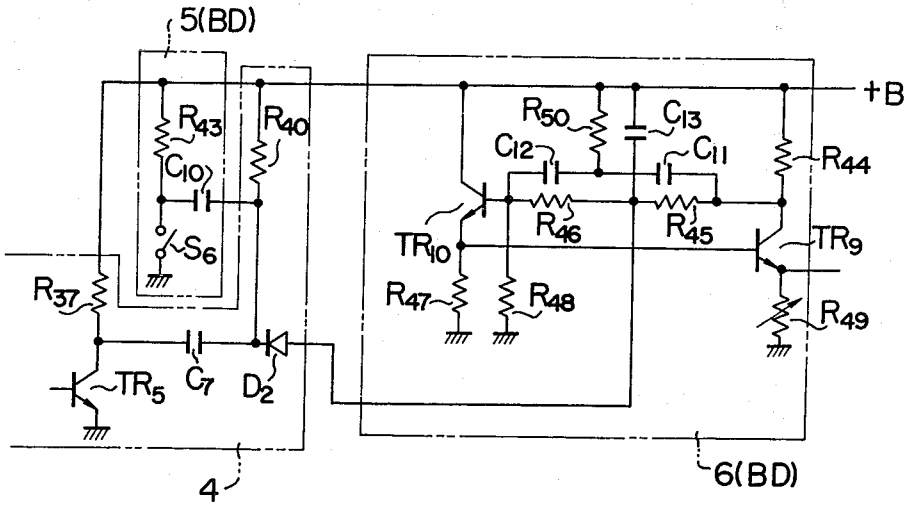

The above and other objects, features and advantages of this invention will become apparent from the following detailed description when taken in conjunction with the accompanying drawings in which:

FIG. 1 is a block diagram of an embodiment of the automatic music playing system according to this invention;

FIG. 2 is a concrete circuit diagram showing one example each of the tempo signal generator 1, the frequency divider 2 and the reset circuit 3 of FIG. 1;

FIG. 3 is a concrete circuit diagram of the matrix circuit 4 of FIG. 1;

FIG. 4 is a logic table illustrating the function of the matrix circuit 4 of FIG. 3; and FIG. 5 is a concrete circuit diagram of one example each of a manual play switch 5, and a tone signal generator 6 of FIG. 1.

Description of the present automatic music playing system hereinbelow will be made on a preferred embodiment referring to the accompanying drawings. FIG. 1 shows an embodiment of the automatic music playing system according to this invention, in which a tempo signal generator 1 for determining the tempo of the automatic play supplies an output signal to a frequency divider 2 consisting of a plurality of cascade-connected flip-flops. A reset circuit 3 is connected with the tempo signal generator 1 and the frequency divider 2 for resetting both of these. The flip-flops in the respective stages of the frequency divider 2 provide required pulse signals to a matrix circuit 4. A group of switch circuits for manual play 5 provides similar output signals to those of the matrix circuit 4. A plurality of tone signal generators 6 is driven by the output signals of the matrix circuit 4 and the manual play switch circuits 5 and generates quasi-sound signals of bass drum, etc. An amplifier 7 synthesizes and amplifies the output signals of the respective tone signal generators and drives a loudspeaker system 8 to generate rhythm sounds. According to the above structure, a desired rhythm can be played manually as well as a predetermined rhythm by the automatic play. Further, desired tone signal generators can be removed from the connecton in the automatic play.

FIG. 2 shows one concrete example each of the tempo signal generator 1, the frequency divider 2 and the reset circuit 3. The tempo signal generator 1 comprises a conventional astable multivibrator consisting of transistors $TR_1$ and $TR_2$, resistors $R_1$ to $R_9$, capacitors $C_1$ and $C_2$, and a diode $D_1$. The oscillation frequency of the multivibrator, i.e. tempo, can be varied by controlling the resistance $R_2$. A bistable multivibrator 21, i.e. a flip-flop, consists of transistors $TR_3$ and $TR_4$, resistors $R_{11}$ to $R_{17}$ and capacitors $C_4$ to $C_6$ and is driven by a signal at the collector of the transistor $TR_2$ of the astable multivibrator 1 through the capacitor $C_4$. Flip-flops 22, 23 and 24 consist of similar circuits to that of the flip-flop 21 and are driven by the output of the flip-flops 21, 22 and 23, respectively. The reset circuit 3 comprises a capacitor $C_3$ connected between the common emitter line of the transistors $TR_2$, $TR_4$, . . . and the ground and a series connection of a resistor $R_{10}$ and a switch SW connected in parallel to the capacitor $C_3$. The operation of the switch SW will be described further. When the switch SW is closed, the astable multivibrator 1 and the flip-flops 21, 22, 23 and 24 perform normal oscillation and frequency division. If the switch SW is opened in this state, the emitters of the transistors $TR_2$, $TR_4$, . . . of the astable multivibrator 1 and the flip-flops 21, 22, 23 and 24 become to be connected with the ground only through the capacitor $C_3$ and then the emitter voltage of those transistors $TR_2$, $TR_4$, . . . rises to reset all of these transistors $TR_2$, $TR_4$, . . . into the offstate.

When the switch SW is closed again after the transistors $TR_2$, $TR_4$, . . . are reset into the offstate, the charge stored in the capacitor $C_3$ is discharged through the resistor $R_{10}$ and the switch SW. Thus, the emitter voltage of the transistors $TR_2$, $TR_4$, . . . recovers the normal state and the astable multivibrator 1 and the flip-flops 21, 22, 23 and 24 begin the normal operation again. Here, on closing the switch SW, if there occurs chattering in the switch SW, the effect thereof on the multivibrator 1 and the flip-flops 21, 22, 23 and 24 can be eliminated by setting a large value for the time constant of the capacitor $C_3$ and the resistor $R_{10}$.

FIG. 3 shows a concrete example of the matrix circuit for automatically playing respective rhythms of march, waltz, fox-trot, rock, etc. with the use of respective tone signal generators for the sounds of bass drum, snare drum, cymbal etc. Input lines denoted as $a, \overline{b}, b, \ldots, \overline{e}$ and $e$ receive pulses $a$ formed at the collector of the transistor $TR_2$ of the astable multivibrator 1, pulses $\overline{b}$ at the collector $TR_3$ of the flip-flop 21, pulses $b$ at the collector of the transistor $TR_4$, and similar output pulses $\overline{c}, c, \overline{d}, d, \overline{e}$ and $e$ of the flip-flops 22, 23 and 24. The matrix circuit 4 comprises a plurality of NOR circuits consisting of resistors $R_{18}$ to $R_{39}$, rhythm selector switches $S_1$ to $S_{5r}$, and transistors $TR_5$ to $TR_8$, and differentiator circuits consisting of resistors $R_{40}$ to $R_{42}$, capacitors $C_7$ to $C_9$ and diodes $D_2$ to $D_4$. The tone signal generator circuit 6 comprises tone signal generators BD, SD and CY triggered by the outputs of the respective differentiator circuits for generating the respective sounds of bass drum, snare drum and cymbal. Assumption is made here that the interlocked rhythm selector switches $S_1$ to $S_5$ are thrown to fixed terminals 1. In this state, the base of the transistor $TR_5$ is applied with the pulses $\overline{b}, \overline{c}$ and $\overline{d}$ through the resistors $R_{18}$ to $R_{20}$ and the switch $S_1$. Thus, this transistor $TR_5$ is cut off only when all the output pulses $\overline{b}, \overline{c}$ and $\overline{d}$ of the frequency divider 2 becomes of low level at the same time. When any one of the output pulses $\overline{b}, \overline{c}$ and $\overline{d}$ of the frequency dividers 2 becomes of high level, said transistor $TR_5$ is turned on. Setting that the signal at the collector of the transistor $TR_5$ is a logic variable X, $X = 1$ when the transistor $TR_5$ is cut off, i.e. the collector is at a high level, $X = 0$ when the transistor $TR_5$ is turned on, i.e. the collector is at a low level, and the logic value of signals $\overline{b}, \overline{c}$ and $\overline{d}$ is 1 when the respective signals are at a high level and is 0 when they are at a low level, the above operation can be expressed by the formula $X = \overline{\overline{b} + \overline{c} + \overline{d}}$, i.e. a NOR logic formula. This is equivalent to the logic of an AND circuit expressed by $X = bcd$ according to the theory of De Morgan.

At the time when the transistor $TR_5$ switches from the off-state to the on-state, the differentiator circuit consisting of the resistor $R_{40}$, the capacitor $C_7$ and diode $D_2$ works to generate a negative pulse at the output terminal. The tone signal generator BD for generating the sound of bass drum is driven by this pulse.

Regarding the transistor $TR_6$, the base is alway applied with the output pulses $\overline{c}$ and $d$ of the frequency divider 2 through resistors $R_{24}$ and $R_{25}$. Thus, the transistor $TR_6$ can be cut off only when the pulses $\overline{c}$ and $d$ are simultaneously at the low level. Here, however, this transistor $TR_6$ is connected in series to the transistor $Tr_7$. Thus, the collector voltage of the transistor $TR_6$ maintains the high level if the transistor $TR_7$ is cut off even when the transistor $TR_6$ is in the on-state. Namely, the collector voltage of the transistor $TR_6$ becomes of the high level when either one of the transistor $TR_6$ or $TR_7$ is cut off. This forms an OR logic circuit.

When the switches $S_1$ to $S_5$ are connected to fixed terminals 1, the base of the transistor $TR_7$ is connected to the +B voltage source through the switch $S_4$ and the resistance $R_{26}$ and the transistor $TR_7$ is always in the on-state. Thus, the differentiator circuit consisting of the resistor $R_{41}$, the capacitor $C_8$ and the diode $D_3$ provides a negative pulse for driving the tone signal generator SD for generating the sound of snare drum only when the transistor $TR_6$ having been cut off becomes to be turned on. As for the transistor $TR_8$, the pulse signal $\overline{d}$ is applied to the base from the frequency divider 2 through the resistor $R_{34}$ and the switch $S_5$. The transistor $TR_8$ is turned off when the pulse signal $\overline{d}$ is at the low level. A negative pulse is generated from the differentiator circuit consisting of the resistor $R_{42}$, the capacitor $C_9$ and the diode $D_4$ when the transistor $TR_8$ is driven from the off-state to the on-state, and triggers the tone signal generator CY for generating the sound of cymbal.

As is described above, when the selection switches $S_1$ to $S_5$ are thrown into terminals 1, the tone signal generators BD, SD and CY for generating the sounds of bass drum, snare drum and cymbal are energized by the differentiated pulses generated when the signals expressed by the following logic formulae (1) change from the high level to the low level.

$$\left.\begin{array}{ll} BD \ldots & \overline{\overline{b}+\overline{c}+\overline{d}} = bcd \\ SD \ldots & \overline{\overline{c}+d} = cd \\ CY \ldots & \overline{\overline{d}} = d \end{array}\right\} \quad (1)$$

Thus, as is shown in the logic table of FIG. 4, the rhythm of march will be played automatically.

Similarly, when the selection switches $S_1$ to $S_5$ are thrown into fixed terminals 2, 3, or 4, the tone signal generators are energized by the differentiation pulses generated when the signals expressed by the respective following formulae (2), (3) or (4) change from the high level to the low level to automatically play the rhythm of waltz, fox-trot or rock as is seen in the logic table of FIG. 4.

$$\left.\begin{array}{ll} BD \ldots & \overline{\overline{e}} = e \\ SD \ldots & \overline{a+\overline{b}+\overline{c+\overline{d}+e+b+\overline{c}+d+\overline{e}}} = \overline{a}b\overline{c}d\overline{e}+\overline{b}c\overline{d}e \\ CY \ldots & \overline{\overline{e}} = e \end{array}\right\} \quad (2)$$

$$\left.\begin{array}{ll} BD \ldots & \overline{\overline{e}} = e \\ SD \ldots & \overline{\overline{c}+d+\overline{\overline{b}+\overline{c}+\overline{d}+e}} = c\overline{d}+bcd\overline{e} \\ CY \ldots & \overline{\overline{b}} = b \end{array}\right\} \quad (3)$$

$$\left.\begin{array}{ll} BD \ldots & \overline{\overline{b}+\overline{c}+\overline{d}+\overline{\overline{b}+c+\overline{d}+e}} = bcd+b\overline{c}d\overline{e} \\ SD \ldots & \overline{\overline{c}+d+\overline{\overline{b}+c+\overline{d}+e}} = c\overline{d}+b\overline{c}d\overline{e} \\ CY \ldots & \overline{\overline{b}} = b \end{array}\right\} \quad (4)$$

In the logic formulae (1) to (4), the NOR logic expressions, for example $\overline{\overline{c}+d}$ for SD in formulae (1), correspond to the logic operation of the circuit of the concrete example and the AND logic expressions, for example $c\bar{d}$ for SD in formulae (1), can be easily derived from the logic table of FIG. 4. Transformation between the NOR logic expression and the AND logic expression is done, as is well known, by the theory of DE Morgan in the Boolean Algebra. When a matrix circuit is formed of combinations of NOR circuits consisting of resistors and a transistor and OR circuits consisting of a series connection of transistors, as in the present embodiment, not of conventional AND-OR circuits by diodes, it can be made at a lower cost and further amplifying waveform-shaping circuits as required for the diode AND-OR circuits become unnecessary due to the amplifying function of the transistor in the NOR circuit, thereby simplifying the circuit structure.

Next, concrete examples of the manual play switches 5 and the tone signal generators will be described. The group of manual play switches 5 comprises a plurality of switching circuits corresponding to the tone signal generators, respectively. Each switching circuit is formed as shown by a block 5(BD) in FIG. 5. In FIG. 5, the transistor $TR_5$, the resistors $R_{37}$ and $R_{40}$, the diode $D_2$ and the capacitor $C_7$ form a part of the matrix circuit 4, more particularly the part for energizing the tone signal generator for bass drum sound, and correspond to those similarly referenced in FIG. 3. The manual play switching circuit for the bass drum sound 5(BD) consists of a resistor $R_{43}$, a capacitor $C_{10}$ and a push button switch $S_6$. A block 6(BD) is a part of the tone signal generators 6, i.e. the bass drum sound signal generator.

The operation of the manual play switch will be described hereinbelow. When the manual play switch $S_6$ is set in the off-state, a negative differentiation pulse is generated through the differentiating circuit consisting of the capacitor $C_7$ connected to the collector of the transistor $TR_5$ and the resistor $R_{40}$ at the moment when the transistor $TR_5$ changes from the off-state to the on-state. The negative pulse excites the tone signal generator 6(BD) through the diode $D_2$. Namely, it drives the tone signal generator 6(BD) at a timing determined by the matrix circuit 4 to perform automatic play. Next, when the manual play switch $S_6$ keeps the on-state, the differentiation pulse due to the on-off change of the transistor $TR_5$ appearing at the interconnection of the resistor $R_{40}$ and the capacitor $C_7$ is absorbed by the capacitor $C_{10}$ connected between the interconnection of the resistor $R_{40}$ and the capacitor $C_7$ and the ground through the closed switch $S_6$, and thereby looses the energy of exciting the tone signal enerator 6(BD) through the diode $D_2$. Namely, when the switch $S_6$ is held to be cloed, the tone signal generator can no longer be excited even when the matrix circuit supplies driving signals to the tone signal generator.

Next, description will be made on the case of closing the manual play switch $S_6$ instantaneously when the transistor $TR_5$ keeps the on- or off-state. When the transistor $TR_5$ keeps the on- or off-state, the voltage at the interconnection of the resistor $R_{40}$ and the capacitor $C_7$ is substantially at the source voltage +B. Therefore, if the manual play switch $S_6$ is momentarily turned on and off, a differentiation pulse is produced at the interconnection of the resistor $R_{40}$ and the capacitors $C_7$ and $C_{10}$ due to the function of the resistors $R_{40}$ and $R_{43}$ and the capacitor $C_{10}$. This negative pulse drives the tone signal generator 6(BD) through the diode $D_2$ to generate the sound of bass drum. Namely, a predetermined sound can be generated by an on-off operation of the manual play switch $S_6$. Here, although description is made on the assumption that the transistor $TR_5$ keeps the on- or off-state, similar operation can be done even in the automatic play.

The manual play switches for the tone signal generators for the snare drum and cymbal have similar structure and operation to those of said manual play switch for the tone signal generator for generating the sound of bass drum.

Next, a concrete example of the tone signal generators 6 will be described. An example of the bass drum sound signal generator 6(BD) is shown in FIG. 5. An oscillating transistor $TR_9$ has a collector connected to the voltage source +B through a resistor $R_{44}$ and an emitter grounded through a variable resistor $R_{49}$. Another transistor $TR_{10}$ achieves the temperature compensation for the transistor $TR_9$ and the impedance transformation, and has an emitter grounded through a resistor $R_{47}$ and connected to the base of the transistor $TR_9$, and a collector directly connected to the voltage source +B. Series connections of resistors $R_{45}$ and $R_{46}$, and capacitors $C_{11}$ and $C_{12}$ are connected between the collector of transistor $TR_9$ and the base of the transistor $TR_{10}$ in parallel. The interconnectons of the resistors $R_{45}$ and $R_{46}$ and the capacitors $C_{11}$ and $C_{12}$ are connected to the voltage source +B through a capacitor $C_{13}$ and a resistor $R_{50}$. Namely, the resistors $R_{45}$, $R_{46}$ and $R_{50}$ and the capacitors $C_{11}$, $C_{12}$ and $C_{13}$ form a known twin-T null circuit. The driving pulse for the tone signal generator is applied to the interconnecton of the resistors $R_{45}$ and $R_{46}$ through the diode $D_2$.

Schematic description will be made on the operation, hereinbelow. The transistors $TR_9$ and $TR_{10}$ are usually in the on-state. When a negative pulse is applied to the interconnection of the resistors $R_{45}$ and $R_{46}$, the transistor $TR_{10}$ is turned off first. When the transistor $TR_{10}$ is turned off, the emitter voltage thereof and hence the base voltage of the transistor $TR_9$ decrease. Thereby, the transistor $TR_9$ becomes to be cut off. Then, the collector voltage of the transistor $TR_9$ increases to thereby turn on the transistor $TR_{10}$. When the transistor $TR_{10}$ is turned on, the emitter voltage thereof increases to thereby turn on the transistor $TR_9$. When the transistor $TR_9$ is turned on, the collector voltage of the transistor $TR_9$ decreases to thereby turn off the transistor $TR_{10}$. The tone signal generator 6(BD) repeats the above cycle until the energy attentuates, i.e. damped oscillation. The duration of the damped oscillation is determined by the loop gain of this circuit and can be controlled by the variable resistance $R_{49}$. The oscillation frequency is determined by the selection of the circuit constants of the twin-T null circuit connected between the collector of the transistor $TR_9$ and the base of the transistor $TR_{10}$. The output of this tone signal generator is derived from the emitter of the transistor $TR_9$ and applied through a low frequency amplifier to a loudspeaker system to provide the sound of bass drum. In such tone signal generators, the oscillation frequency and the attenuation time can be varied by varying the circuit constants of the twin-T null circuit and the emitter resistance $R_{49}$ for the transistor $TR_9$ to constitute various tone signal generators for generating various tones such as low bongo, high bongo, etc.

According to the results of experiments carried out by the present inventors, the method of applying a negative differentiation pulse to the interconnection of the resistors $R_{45}$ and $R_{46}$ as is described above was superior for generating excellent quasi-sounds without clicks. When it is preferred to generate clicking sounds, negative or positive differentiation pulse may be applied to the base of the transistor $TR_{10}$.

It will be apparent that this tone signal generator can also be applied to other devices, such as the alarm in an alarm clock. The tone signal generators for the sound of snare drum and cymbal and the low frequency amplifier are those of conventional techniques and the details thereof are dispensed with from the description.

What we claim is:

1. An automatic music playing system comprising:

a tempo signal generating circuit for generating a pulse signal determining the tempo of an automatically played rhythm;

a frequency divider circuit including a plurality of flip-flop circuits having output terminals in cascade connection with said tempo signal generating circuit for dividing the frequency of the pulse signal of said tempo signal generating circuit;

a matrix circuit connected to the output terminals of said plurality of flip-flop circuits and having output terminals for generating a plurality of driving signals of predetermined patterns;

a plurality of tone signal generating circuits connected to the output terminals of said matrix circuit for producing tone signals for rhythm sounds of musical instruments based on the driving signals from the matrix circuit;

a voltage source;

a plurality of manual play switch circuits provided between said matrix circuit and corresponding tone generating circuits, each said manual play switch circuit comprising means having an off-state to allow the driving signal from the matrix circuit to trigger the corresponding tone signal generating circuit, an on-state for clamping the matrix output to prevent the driving signal from triggering the tone signal generator circuit, and a momentary on-off state to provide a manually generated trigger signal for said tone signal generating circuit, each switch circuit comprising a series-connected manual switch and capacitor connected in parallel with an output of said matrix circuit, and a resistor connected between said voltage source and the junction of said manual switch and said capacitor;

an amplifier circuit connected to outputs of said tone signal generating circuits for amplifying and mixing tone signals produced by the tone signal generating circuits; and a loudspeaker system connected to outputs of said amplifier circuit for converting the tone signals into sound waves.

2. An automatic music playing system according to claim 1, in which said tempo signal generating circuit comprises an astable multivibrator including two transistors, and said frequency divider circuit comprises at least one flip-flop circuit including two transistors, said automatic music playing system further comprising a reset circuit including a further capacitor connected to the emitters of one transistor of each of said tempo signal generating circuit and said flip-flop circuit, and a series connection of a resistor and a switch connected in parallel to said further capacitor.

3. An automatic music playing system according to claim 1, in which said matrix circuit includes a plurality of transistors each having an emitter, a base and a collector, whose bases are connected to respective output terminals of flip-flop circuits of said frequency divider circuits through predetermined groups of resistors, two of said transistors having such a connecton that the collector of one transistor is connected to the emitter of the other transistor and the tone generator driving signal is derived at the collector of said other transistor.

4. An automatic music playing system according to claim 1, in which at least one of said tone signal generating circuits is a percussion sound signal generating circuit comprising a first series connection of at least two resistors, a second series connection of at least two capacitors, the first and second series connections being connected in parallel, another capacitor connected between the junction of said two series-connected resistors and said voltage source, another resistor connected between the junction of said two series-connected capacitors and said voltage source, and first and second oscillating transistors, each having a collector, a base and an emitter, the parallel connecton of the series-connected capacitors and the series-connected resistors being connected between the collector of said first transistor and the base of said second transistor, the base of said first transistor being connected to the emitter of said second transistor, and said junction of the series-connected resistors being supplied with the driving signal derived from said matrix circuit and said manual switch circuit.

5. An automatic music playing system according to claim 1, wherein said manual switch has one terminal connected to the junction of said resistor and capacitor and a second terminal connected to ground.

* * * * *